United States Patent [19]

Berchowitz

[11] 4,395,880

[45] Aug. 2, 1983

[54] DOUBLE ACTING STIRLING ENGINE PHASE CONTROL

[75] Inventor: David M. Berchowitz, Scotia, N.Y.

[73] Assignee: Mechanical Technology Incorporated, Latham, N.Y.

[21] Appl. No.: 242,453

[22] Filed: Mar. 11, 1981

[51] Int. Cl.[3] ..... F02G 1/06

[52] U.S. Cl. ..... 60/518; 60/525; 74/401; 74/665 GD

[58] Field of Search ..... 60/517, 518, 525; 74/401, 665 G, 665 GA, 665 GD, 828

[56] References Cited

U.S. PATENT DOCUMENTS

| | | | |
|---|---|---|---|
| 2,327,787 | 8/1943 | Heintz | 74/401 X |
| 3,457,722 | 7/1969 | Bush | 60/518 |
| 3,538,706 | 11/1970 | Toepel | 60/518 |
| 3,742,719 | 7/1973 | Lagodmos | 60/518 |
| 4,228,656 | 10/1980 | MacGlashan, Jr. | 60/518 |
| 4,230,026 | 10/1980 | Hartley | 92/138 |
| 4,357,799 | 11/1982 | Vos | 60/518 |

OTHER PUBLICATIONS

N. E. Polster and W. R. Martini, "Self-Starting Intrinsically Controlled Stirling Engine", 11th IECEC, 1976 Record, pp. 1511–1518.

*Primary Examiner*—Allen M. Ostrager
*Assistant Examiner*—Stephen F. Husar
*Attorney, Agent, or Firm*—Joseph V. Claeys; Arthur N. Trausch, III

[57] ABSTRACT

A mechanical device for effecting a phase change between the expansion and compression volumes of a double-acting Stirling engine uses helical elements which produce opposite rotation of a pair of crankpins when a control rod is moved, so the phase between two pairs of pistons is changed by $+\psi$ and the phase between the other two pairs of pistons is changed by $-\psi$. The phase can change beyond $\psi=90°$ at which regenerative braking and then reversal of engine rotation occurs.

25 Claims, 10 Drawing Figures

LEGEND

| | NO. | PHASE ANGLE |
|---|---|---|
| PISTON | 1 2 | $90^0 + 2\alpha$ |
| | 2 3 | $90^0 - 2\alpha$ |
| | 3 4 | $90^0 + 2\alpha$ |
| | 4 1 | $90^0 - 2\alpha$ |

LEGEND

| | NO. | PHASE ANGLE |
|---|---|---|
| P | 1 | $90^0 - 2\alpha$ |
| | 2 | |
| S | 2 | $90^0 + 2\alpha$ |
| T | 3 | $90^0 - 2\alpha$ |
| O | 4 | |
| N | 4 | $90^0 + 2\alpha$ |
| | 1 | |

| | | | | | | | |
|---|---|---|---|---|---|---|---|
| PHASE ANGLE | | $60^0-(\alpha+\beta)$ | | $60^0-(\alpha+\beta)$ | | $60^0-(\alpha+\beta)$ | |
| PISTON NO. | 1 | 2 | 3 | 4 | 5 | 6 | 1 |
| PHASE ANGLE | $60^0+(\alpha+\beta)$ | | $60^0+(\alpha+\beta)$ | | $60^0+(\alpha+\beta)$ | | |

LEGEND

DOUBLE ACTING STIRLING ENGINE PHASE CONTROL

BACKGROUND OF THE INVENTION

The Government of the United States of America has rights in this invention pursuant to Contract No. DEN 3-32 awarded by the U.S. Department of Energy.

This invention relates to power control for a kinematic engine and more particularly to a device for a Stirling engine lower end which controls the power output of the direction of rotation of the output shaft, thereby performing the functions of the power control and transmission in a conventional vehicle.

The high efficiency, clean and quiet operation of the Stirling engine makes it an attractive candidate for replacing the internal combustion engine in many applications including automobile drive systems. The realization of this potential, however, has been elusive because the cost and reliability of Stirling engine systems developed to date has made the Stirling engine uncompetitive with the internal combustion engine.

In particular, the prior art power control system for the Stirling engine requires a large and sophisticated mean pressure control system designed to change the mean pressure in the engine as fast as possible to reduce the response time. This system is limited by the maximum flow rate and the hydrogen compressor capacity. Although large valves and ducting and capacity compressors can be designed for fast response, nevertheless in the nature of the engineering trade-offs involved in the design, the response time between power extreme is excessive from a consumer acceptance point of view and therefore these engines in their present form are mere laboratory and engineering curiosities rather than practical engine designs.

A second area of improvement needed in the Stirling engine field is in the motion conversion mechanism which converts reciprocating motion of the piston rods to rotating motion of a power output shaft. The existing systems are reliable and acceptably efficient, however these acceptable qualities are bought at the price of single functionality and inflexibility. It would be desirable if the large weight, volume, and cost of the motion conversion mechanism could be made more cost effective by modifications which would eliminate or simplify other components in the engine to lower its overall cost and weight, improve its reliability, and otherwise contribute to the realization of the potential of the Stirling engine.

One potential mode of operation for which the Stirling engine is ideally suited is regenerative braking. In conventional heat engines, including conventional Stirling engines, the heat loss in the braking system is merely dumped into the atmosphere. The Stirling engine, however, has the capability of operation in the heat pump mode in which the kinetic energy stored in the moving parts and in the moving mass of the mechanism to which the engine is attached, such as an automobile, can be reconverted back into heat. If a heat storage medium is provided, this heat can be stored and later reconverted by the Stirling engine back into kinetic energy.

The exciting potential for overall system efficiency improvement provided by regenerative braking is enhanced by another possibility that a heat storage system affords. If heat can be stored in a medium surrounding the Stirling engine heater, it becomes possible to use the heat storage medium as the engine energy storage vessel itself. The engine and its heat storage vessel may then be operated independent of other energy stores, such as a gasoline tank or other chemical energy storage sources, to power the engine. This would provide an energy storage system for limited range vehicles such as commuter cars or delivery vans which can operate with no exhaust emissions whatsoever and virtually silently. These vehicles can also be designed as hybrid vehicles using a heat storage medium which can be charged oernight, and a small clean combustor designed for operation at optimum efficiency to burn continuously to supply heat to the storage medium during extended trips and not at all on short trips. The flexibility of the vehicle would thereby be improved at small cost in terms of volume, weight, and expense.

A regenerative braking scheme for a Stirling engine requires that the phase relationship of the pistons be changed from the work output mode in which the gas is compressed at low temperature in the compression space and expanded at high temperature in the expansion space, to a heat pump mode in which the gas is expanded at low temperature in the cold space where it absorbs heat and is compressed at high temperature in the hot space where it rejects heat. In the work output mode, heat flows from the heater to the cooler and in the process, some of the heat is transformed into mechanical work. In the heat pump mode, heat is pumped from the cold space to the hot space by the expenditure of mechanical work thereby raising the heat content of the hot space. Thus the kinetic energy is removed from the mechanical system and is used to store heat which is available for later recoversion into mechanical work.

This phase control is readily accomplished in a displacer-piston engine by merely changing the phase of the pistons and the displacers. This is so because each displacer-piston pair functions, in effect, as a separate engine and the power output of each of these "separate engines" is merely added to the output shaft.

In a double-acting engine, however, it has been accepted in the art that phase control is not possible because the phase difference between all of the pistons in a double-acting engine must always add up to 360°. Therefore, it has been assumed the phase difference between the pistons must be equal to exactly 360° divided by the number of pistons.

It would be desirable to employ a phase control device in a double-acting Stirling engine because a double-acting engine is compact and has fewer moving parts compared with displacer-piston types. Its advantages cooperate ideally with the advantageous potential offered by a phase control device operating in connection with a heat storage arrangement which permits the use of regenerative braking and heat storage/combustion hybrid vehicles. In addition, a phase control scheme in a double-acting Stirling engine would eliminate or simplify the conventional mean power control used in that engine. A phase control arrangement in a double-acting engine would permit the engine to self start immediately without the necessity of a cranking mechanism. Finally, it would permit the engine to be operated in reverse, thereby eliminating the reverse gear in transmission or, if the engine is sized appropriately, eliminating the transmission altogether. The reduction in weight and cost in such an engine would be of great value in the Stirling engine technology and would bring the technology a quantum step closer to practical implementation in commerce and industry.

SUMMARY OF THE INVENTION

Accordingly, it is an object of this invention to provide a phase control device for a double-acting Stirling engine. The phase control device is employed in combination with a heat storage medium for regenerative braking and energy storage for hybrid vehicle applications. The double-acting engine phase control scheme is also used in combination with a simple mean pressure control which enables the engine to be operated at low pressure and low power with high efficiency and fast response.

These and other objects of the invention are achieved in the disclosed preferred embodiments of the invention by a device which shifts the phase between the pistons in each thermodynamically coupled pair of pistons in a double-acting Stirling engine so that the phase shift between the first and second pistons is additive, and the phase shift between the second and third pistons is subtractive and so on, alternately, for as many pistons as there are in the engine. In this way, the phase angle of the first working space is increased by the shifted angle and the phase angle of the second working space is decreased by an equal angle. The engine is designed to operate so that the peak power position occurs at or near the position where all phase angles are equal and decreases approximately equally with equal additive and subtractive changes in the phase angle. In this way, the power output of each working space remains approximately equal at all phase angles. Therefore, the torque vibrations in the output shaft and the crankcase gearing, which would normally occur in the event of unequal power output from the piston rods, does not occur so that the power flow from the engine is smoothed and the internal stresses in the crankcase are small.

DESCRIPTION OF THE DRAWINGS

The invention and its many attendant objects and advantages will be better understood upon reading the following detailed description of the preferred embodiments in conjunction with the following drawings, wherein:

FIG. 7 is a perspective plan view of a fifth embodiment of a phase control mechanism embodying this invention in a crank machine having six pistons.

DESCRIPTION OF THE PREFERRED EMBODIMENTS

Figure 1:
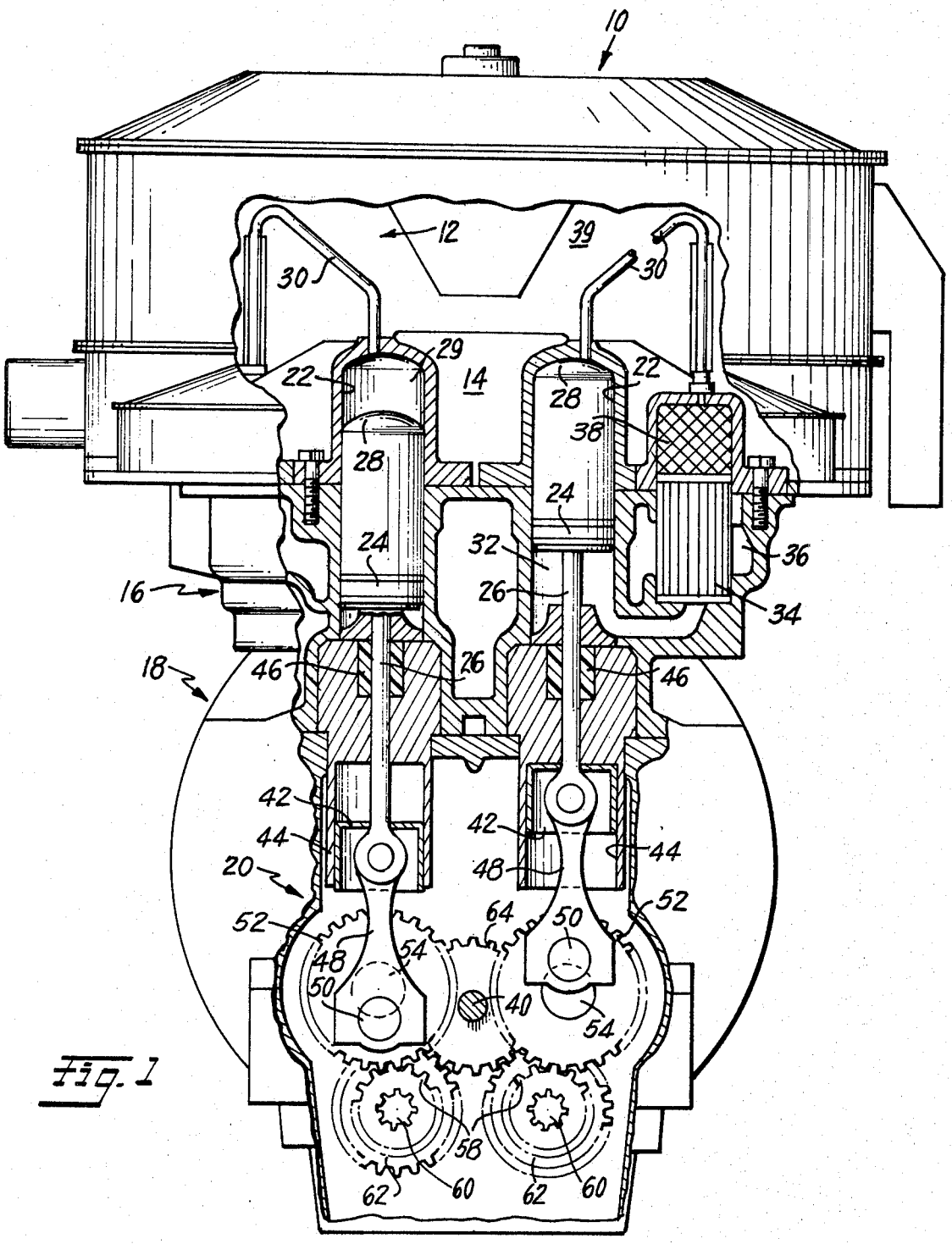
FIG. 1 is a schematic elevation of a double-acting Stirling engine employing a phase control mechanism according to this invention.

Turning now to the drawings, wherein like or primed reference characters designate identical or corresponding parts respectively, and more particularly to FIG. 1 thereof, a double-acting Stirling engine is shown having a combustor 10 mounted on a heater 12 which in turn is mounted on a heater head 14 of the engine. The heater head 14 is mounted on a water jacket 16 which in turn is mounted on a crankcase 18 which contains a motion conversion mechanism 20 for converting the reciprocating motion of the pistons to rotating motion of the output shaft.

The heater head 14 includes a plurality of cylinders 22 which receive pistons 24 connected to piston rods 26. A piston dome 28 is mounted atop each of the pistons 24 and extends upwardly into the cylinder 22 for displacing hot working gas from the volume of the cylinder 22 above the dome 28, or expansion space 29 into a set of tube 30 of the heater 12. Likewise, the piston 24 on its downstroke, displaces working gas from the volume of the cylinder 22 below the piston 24, or compression space 32, through a cooler 34 cooled by water circulating through cooling channels 36, through a regenerator 38 and into the heater tubes 30 of the preceding adjacent cylinder 22. The heater 12 can incorporate a thermal energy storage system incorporating a heat storage medium 39 as shown, for example, in U.S. Pat. No. 4,126,995 and ASME Paper 80-C2/Sol-13 entitled "Sodium Heat Pipe Use in Solar Stirling Power Conversion Systems" by W. F. Zimmerman, et. al. The heat storage medium 39 partially or completely surrounds the heater tubes 30 so that they are protected from overheating and for good thermal exchange with the heat storage medium 39 during power generation and also during regenerative heat pumping, as explained in more detail below.

The expansion space 29 of cylinder No. 1 is connected via its heater tubes 30, and through a series connected regenerator and a cooler (not shown), to the compression space 32 of cylinder No. 2, which is the thermodynamically coupled cylinder whose piston leads the piston in cylinder No. 1 by 90°. Likewise, the compression space 32 of cylinder No. 1 is connected through the series connected cooler, regenerator and heater (not shown) to the expansion space 29 of cylinder No. 4, which is the thermodynamically coupled cylinder whose piston lags the piston in cylinder No. 1 by 90°. This cyclic action causes a cyclic pressure wave in the working gas in the working space of the engine which produces a downward force on the piston rods 26 which is converted by the motion conversion mechanism 20 into rotating power of an output shaft 40.

The reciprocating motion of each of the piston rods 26 is nearly perfectly linear because it is guided for linear motion by a cross head 42 travelling in a cross head guide 44. The linear motion is important because the working space of the engine is maintained at high pressure and must be sealed against loss of working gas by a piston rod seal assembly 46. The problem of sealing the gas in the working space against loss between the piston rod 26 and the seal assembly is partially a function of the lateral movement of the piston rod 26 and therefore the cross head mechanism is designed to absorb the lateral component of the forces exerted on the piston rod.

The lower end of the piston rod where it connects to the cross head 42 is connected to a connecting rod 48 which in turn is pinned at its lower end to a crankpin 50 mounted eccentrically on a gear 52. Reciprocating motion of the piston rod 26 acting through the connecting rod 48 drives the crankpin 50 and its attached gear 52 in rotating motion. The gear 52 is mounted on a stub shaft 54 journalled in the crankcase 18. The stub shaft 54 can be a single shaft fixedly mounted in the crankcase with the gear 52 journalled on bearings for rotation relative to the stub shaft, or the stub shaft itself may be mounted on bearings with the gear 52 keyed to the shaft. In either case, the crankpin 50 must be on the side of the stub shaft which does not project beyond the gear so that the connecting rod 48 may be connected to and rotate with the crankpin without interference with the stub shaft 54.

Figure 2:
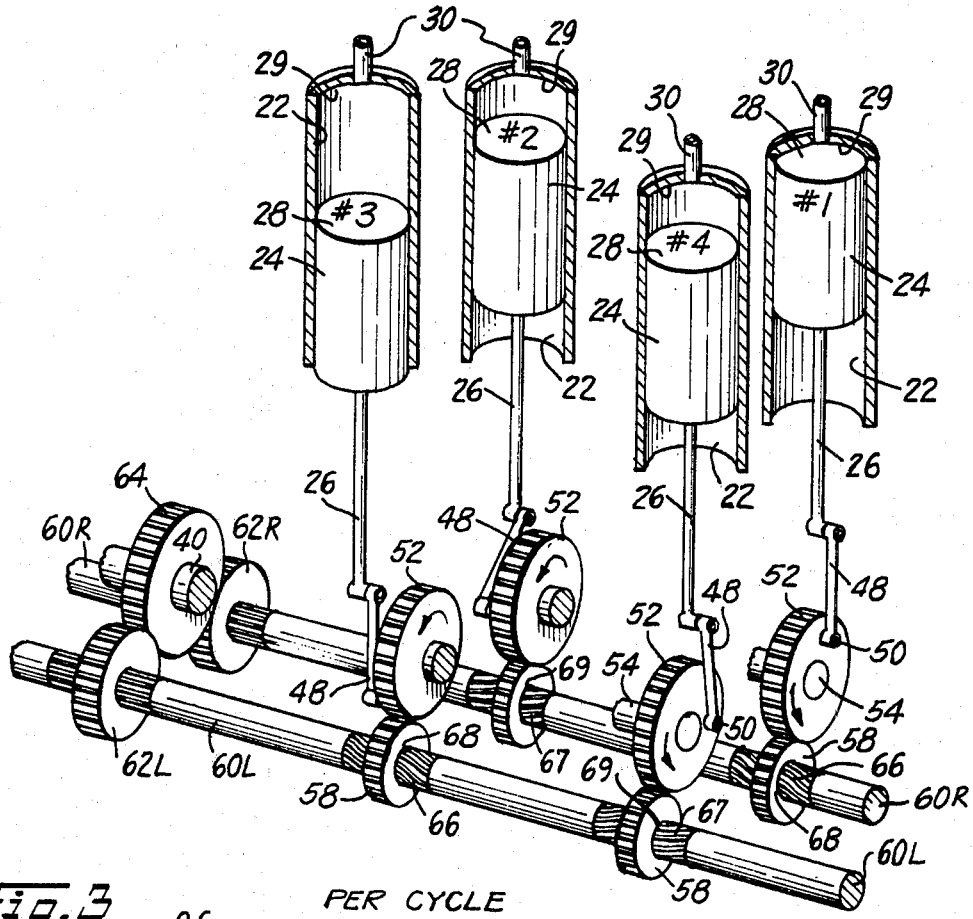
FIG. 2 is a perspective view of the pistons, cylinders and phase controllable motion conversion mechanism embodying the invention in the engine shown in FIG. 1.

Four crank gears 52 shown in FIG. 2, engage corresponding phase gears 58 which are mounted on a pair of shafts 60 R and L. The engine is in a form of a square, with two phase gears 58 mounted on each of two shafts 60. At the end of each shaft 60 there is a gear 62 R and L slidably mounted on the respective shaft 60 in torque transmitting relation by virtue of a set of splines which engage internal teeth on the gear 62. The two gears 62 on the ends of the shafts 60 engage a single output gear 64 keyed to the output shaft 40.

The phase gears 58 are connected to the shaft 60 by a helical spline or grooves 66 or 67 which engage internal helical teeth 68 or 69 on the gears 58. Thrust bearings (not shown) are provided on both sides of the gears 58 to support them axially so that they stay in meshing alignment with the crank gears 52. The opposite hand on the two sets of splines 66–68 and 67–69 on each shaft causes cancellation of axial force exerted by the phase gears 58 through the splines on the shaft 60.

To change the phase relationship of the crankpins 50 relative to each other, it is necessary merely to move the shafts 60 axially which causes the helical grooves 66 or 67 in the shafts to move and rotate the two gears 58 on each shaft 60 in opposite directions. The motion of the two shafts 60 R and L in the same direction causes the gears 58 coupled to thermodynamically connected pistons to rotate in opposite directions thereby rotating the gears 52 and the crankpins 50 in opposite directions to change the phase angle of each pair of thermodynamically connected pistons in the cylinders which they control.

Cylinder No. 1 as illustrated in FIG. 2 is initially at TDC, and its crank gear 52 is at what will be arbitrarily considered the zero angle position. Cylinder No. 2 has descended to the midstroke height and its crank gear 52 is at the 90° position. Cylinder No. 3 is at BDC and its crank gear 52 is at 180°. Cylinder No. 4 has ascended to midstroke and its crank gear 52 is at the 270° position. Thus, the phase relationship of the engine shown in FIG. 1 is a classic four cylinder Siemens double-acting Stirling engine configuration wherein the pistons are exactly 90° phase displaced from their thermodynamically connected adjacent pistons. This phase relationship can be changed by an equal axial movement of both rods 60 R and L in the same direction which causes an equal and opposite rotation of the gears 58 connected to thermodynamically coupled pistons. Thus, the phase angle between the first two pairs of pistons, viz. pistons Nos. 1–2 and 3–4 wherein the pistons in each of the two pairs are both connected to a single shaft, respectively, increases by twice the angle of adjustment $\alpha$ of the crankpins 50 to $90°+2\alpha$. The phase adjustment between the pistons of the other two pairs, viz. Nos. 2–3 and 4–1, driven by crankpins linked to separate shafts, is also twice the angle of adjustment $\alpha$, but instead of additive, the relative direction of rotation brings the crank angle of the crankpins closer together so that the phase angle between the pistons in the other two pairs is $90°-2\alpha°$. Thus, the total phase relationship between the four pistons remains a full 360°, but the phase relationship between thermodynamically adjacent pistons is shifted by $2\alpha$ and in the opposite direction between adjacent working spaces.

Figure 3:
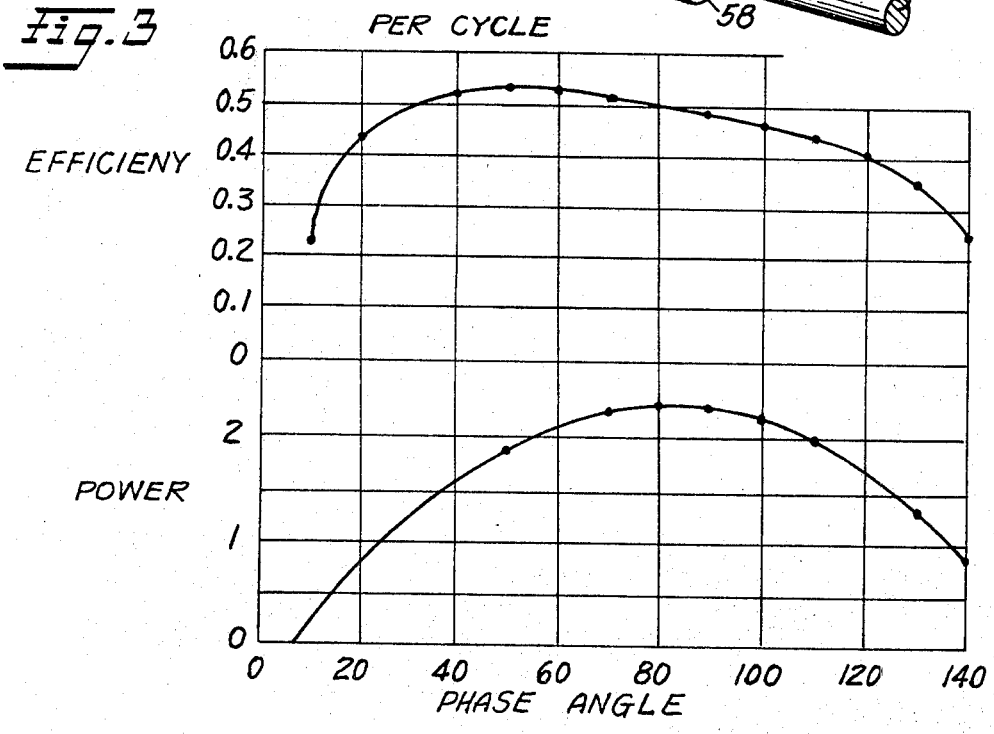
FIG. 3 is a pair of graphs showing power and efficiency as a function of phase angle.

Turning now to FIG. 3, wherein efficiency and power per cycle are plotted as a function of phase angle, it can be seen that the efficiency changes little over a phase angle range of approximately 30°–40° on either side of the 90° phase angle position. Moreover, maximum power is attained very nearly at the 90° position. Therefore, an equal angular displacement from the 90° position will result in approximately equal change in power level so that the power in each cylinder is about equal irrespective of the phase angle between the upstream adjacent and the downstream adjacent piston.

To improve the already excellent power match between the cylinders at phase positions rather than 90°, it is possible to configure the interior dimensions of the working space, the heat exchangers, and power pistons such that the maximum power position occurs at exactly the 90° phase position. From there, an equal and opposite phase shift between adjacent working spaces results in an overall engine power decrease with virtually zero relative power change between the four pistons. Therefore, the power output from all the cylinders is equal, producing an equal torque load on the driveshaft.

Figure 4:
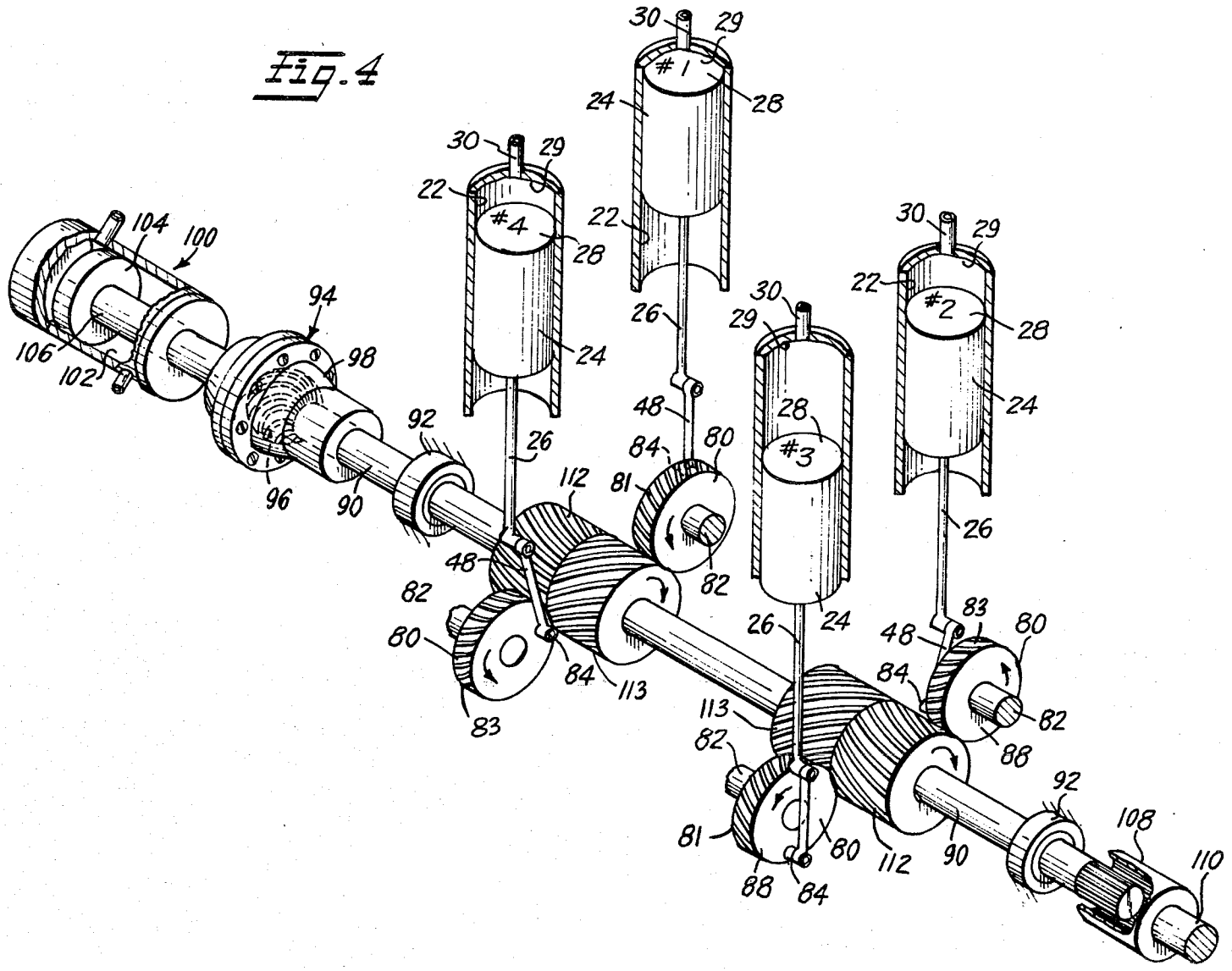
FIG. 4 is a perspective view of a second embodiment of a phase control mechanism embodying this invention.

Turning now to FIG. 4, a single driveshaft embodiment of the invention is mounted in the crankcase of the double-acting Stirling engine illustrated in FIG. 1, replacing the mechanism shown in FIG. 2. It includes a set of crank discs 80 whose outer cylindrical peripheries are mounted as helical gears 81 or 83 and are mounted on stub shafts 82 journalled in the crankcase of the engine. Each of the crank discs 80 has a crankpin 84 connected near its outer edge in a manner identical to that shown for FIGS. 1 and 2, and is supported radially and axially by bearings (not shown). The relative phase position of the crankpins 84 is TDC or 0° for cylinder No. 1, 90° for cylinder No. 2, BDC or 180° for cylinder No. 3 and 270° for cylinder No. 4. The expansion space in each cylinder is counted through a heater, cooler and regenerator (not shown) to the compression space of the next higher numbered cylinder, as in the embodiment of FIG. 3.

A single drive shaft 90 is journalled in the crankcase 18 on sleeve bearings 92 that support the shaft radially and permit the shaft to move axially. At the end of this shaft 90 is a spherical hydrodynamic thrust bearing 94 including a spherical, helically grooved ball 96 rotating in a spherical socket 98. The socket is moved axially by a hydraulic actuator 100 which includes a double-acting hydraulic chamber 102 acting on a hydraulic piston 104 connected to the socket 98 by a short shaft 106. The shaft 90 is connected to an output driveshaft 110 by a splined connector 108 which transmits torque but not axial movement to the driveshaft 110. The actuating force is very small because the opposite hand on the helical gears results in a cancellation of axial forces exerted on the shaft 90.

The shaft 90 has a set of opposite hand helical gears 112 and 113 kyed to the shaft 90 separately and in engagement with the helical gear edges 81 and 83 of the individual crank discs 80. When the shaft 90 is moved axially, the crank discs 80, which are fixed axially by axial thrust bearings (not shown), will rotate to accommodate the axial movement of the helical gears 112 and 113. The opposite hand 81 and 83 of the helical gears 80 on thermodynamically adjacent crank discs causes their rotation in opposite directions.

In operation, the piston rods connected by way of the connecting rods to the crankpins 84 drive crank discs 80 which are engaged with helical gears 112 and 113 and drive the shaft 90 to produce rotary output power. When it is desired that the kinetic energy in the machine to which the engine is attached, such as automobile, be converted to heat which can be stored in a heat storage medium for later reconversion to mechanical energy, the phase of each piston is shifted by 90° so that the phase relationship of adjacent pistons changes from a 90° leading or lagging position to a 90° lagging or leading position, respectively. At the new position, the thermodynamic cycle defined between adjacent pistons becomes a heat pump at maximum energy absorption wherein the thermodynamic cycle pumps heat from the cooler into the heater where it is absorbed by the heat storage medium 39.

When the mechanical energy is fully absorbed from the mechanical system, the engine will commence to run in the opposite direction, functioning again as a heat engine producing mechanical energy from the heat in the heat storage medium and producing output torque in the direction opposite to the direction of rotation in which energy was absorbed from the mechanial system.

Intermediate phase positions of the pistons produce intermediate effects. That is, a phase shift of each of the pistons by 45° will put two of the pistons in the same phase position and the other two also in the same phase position but 180° apart from the first two. This is the start position and results in no power input to the pistons from the thermodynamic system, and no transfer of gas, so that the system is stationary. That is the position in which the engine is maintained when it is not running.

To start the engine, it is merely necessary to shift the phase position of the pistons which causes a transfer of gas through the heat exchangers and produces a pressure change in the working space which starts the engine moving. The starter motor, solenoid and associated electrical controls for cranking the engine are thus unnecessary, and the storage battery and generator can be much smaller or possibly eliminated altogether. Since the heat storage medium is maintained at the working temperature by an effective insulation system, there is no delay time in starting the engine and indeed it is not necessary even to ignite the combustor until the engine is running. Thus, all auxiliary power demands can be supplied directly from the mechanical system when the engine is running and whatever small electrical demands there may be, if any, can be supplied from a small generator.

Figures 5, 5A:
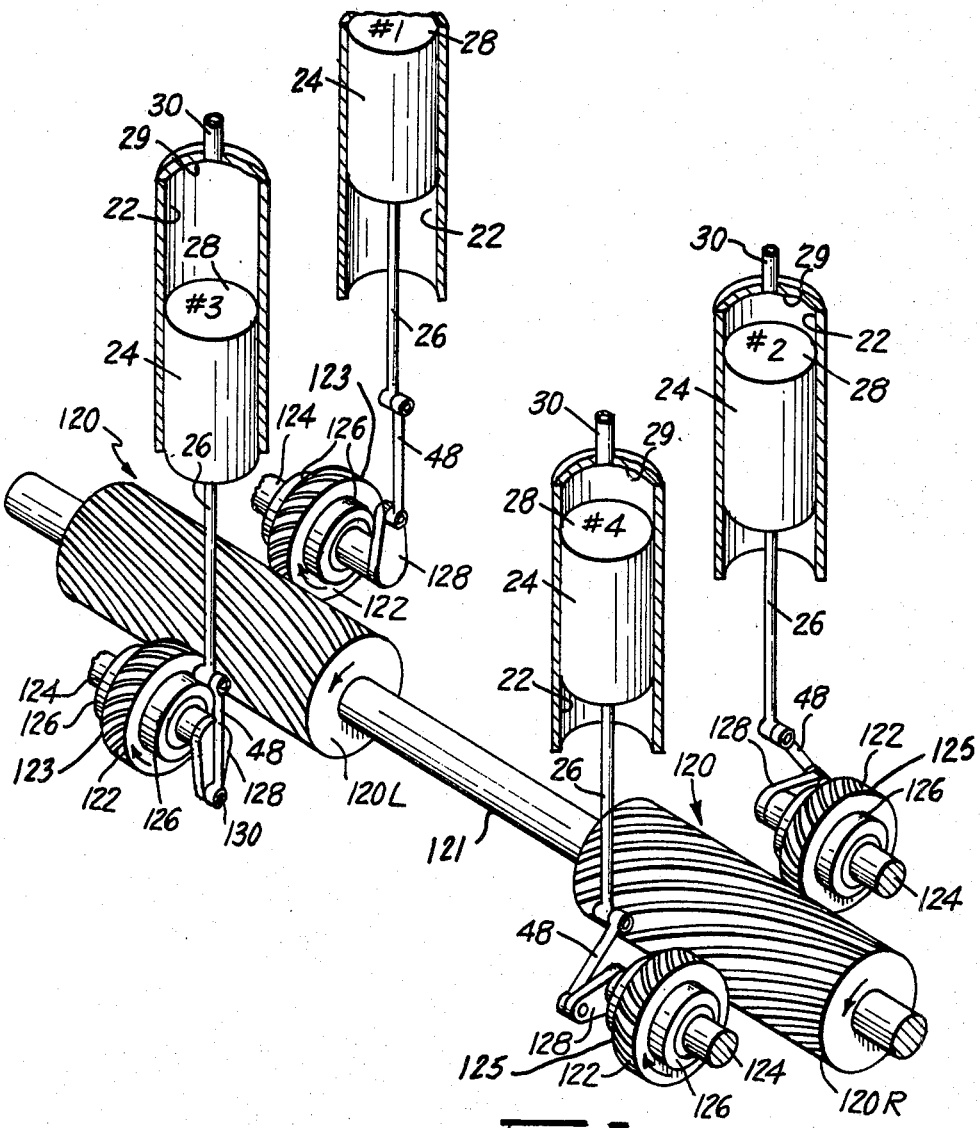
FIG. 5 is a perspective view of a third embodiment of a phase control mechanism embodying this invention.
FIG. 5A is a chart showing the phase relationships between the pistons in each pair of thermodynamically coupled pistons in the engine shown in FIG. 5.

FIG. 5 shows a variant of the embodiment of FIG. 4 wherein only two helical gears 120 R and L of opposite hand on a single output shaft 121 are used because a slightly different arrangement of the cylinders is used. The helical crank gears 122 of one hand 123 for piston Nos. 1 and 3 engage the leftmost helical gear 120L and the helical crank gears 122 of opposite hand 125 for the cylinder Nos. 2 and 4 engage the rightmost helical gear 120R. The helical crank gears 122 are keyed to stub shafts 124 mounted in the crankcase in journal and thrust bearings (not shown). One end of the stub shaft 124 is formed in, or has attached thereto a crank 128 having a crankpin 130 which connects to the engine connecting rod in the same manner as the crankpin 50 in the embodiment FIGS. 1 and 2. In all other respects, the structure and operation of the embodiments of FIGS. 4 and 5 are alike.

Figures 6, 6A:
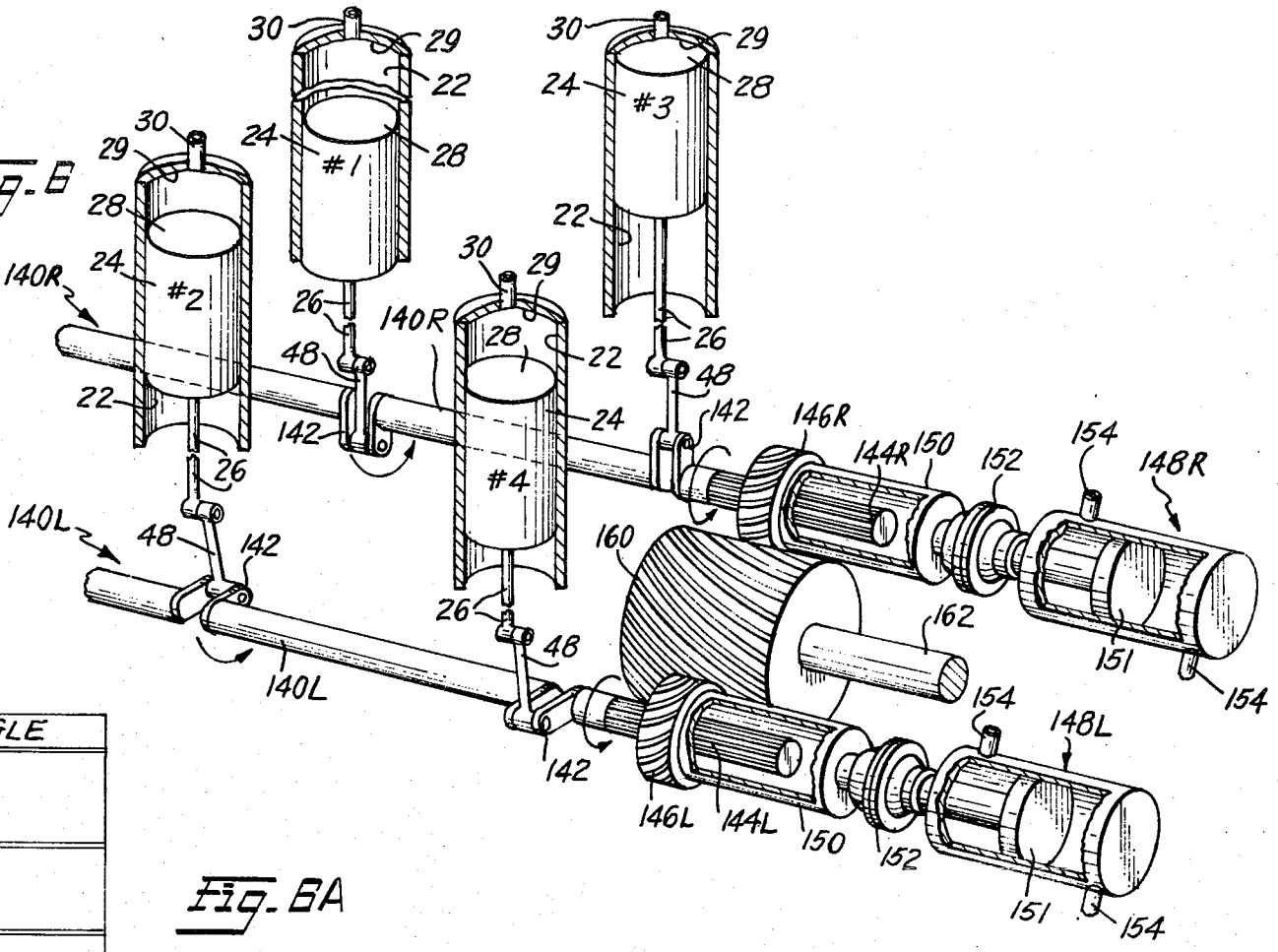
FIG. 6 is a perspective view showing a fourth embodiment of a phase control mechanism embodying this invention in a crank machine.
FIG. 6A is a chart showing the phase relationships between the pistons in each pair of thermodynamically coupled pistons in the engine shown in FIG. 6.

Turning now to FIG. 6, another form of phase adjustment mechanism is shown having a pair of crankshafts 140 R and L journaled for rotation in the crankcase of the engine shown in FIG. 1. Each crankshaft 140 has a pair of cranks 142 arranged at 180° phase angle relative to each other. The crank angles of the two shafts 140 are offset by 90° so that the two cranks on the right crankshaft 141R are each normally 90° offset from the two cranks on the left crankshaft 140L. The phase position of the four cranks relative to one another is illustrated in FIG. 6.

The end of each crankshaft 140 R and L has an elongated spline section 144 R and L which receives a helical gear 146 R and L slidably arranged on the spline section 144 so that it can move axially therealong while engaging the spline 144 in torque transmitting relationship. A hydraulic actuator 148 R and L is provided to control the axial position of the helical gear 146 on the spline section 144 of the crankshaft 140. The hydraulic actuator 148, shown schematically, is a tube 150 connected to the gear 146 and connected to a hydraulic piston 151 by a thrust bearing 152 like the thrust bearing 94 in FIG. 4. A pair of hydraulic lines 154 run to a hydraulic chamber 156 for conveying an actuating hydraulic pressure to the hydraulic chamber 156 for moving the piston 151 axially and thereby controlling the axial position of the gear 146.

The two gears 146 engage a helical gear 160 which is keyed to an output shaft 162. The axial width of the helical gear 160 is sufficient to permit the helical gears 146 to move throughout their full range of motion and still remain engaged with the gear 160.

In operation, the nominal position of the gears 146 will be such as to position the two adjacent cranks 142 on crankshafts 140R and 140L at 90° displaced positions. When it is desired to reduce power, put the engine in regenerative braking configuration, or operate the engine in reverse, the hydraulic actuators are moved in opposite directions to rotate the shafts 140R and 140L in opposite directions to each other. This causes the crank angle of the crank for piston No. 1 to advance by an angle $\alpha$ and the crank for piston No. 2 to retreat by an angle $\alpha$. Therefore, as shown in FIG. 6A, the new phase angle between piston Nos. 1 and 2 will be $90°-2\alpha$. Pistons 2 and 3, also connected to cranks on separate crankshafts, will be moved in opposite directions so that the crank angle between these two pistons becomes $90°+2\alpha$. The cranks connected to pistons 3 and 4 will, like the cranks connected to pistons 1 and 2, will be brought closer together so that the phase angle between them will be $90°-2\alpha$. The cranks connected to pistons 4 and 1, like the other three pairs, are on opposite crankshafts and therefore the phase angle, like that for crank Nos. 2 and 3, will be additive. Therefore, the phase angle between the pistons 4 and 1 will be $90°+2\alpha$. Thus, the total phase displacement between the 4 pistons is a full 360° and the phase displacement between the adjacent pairs of pistons is equal and opposite. This arrangement permits the use of the conventional crank mechanism and minimizes retooling of existing production facilities to incorporate the invention.

Figure 7A:
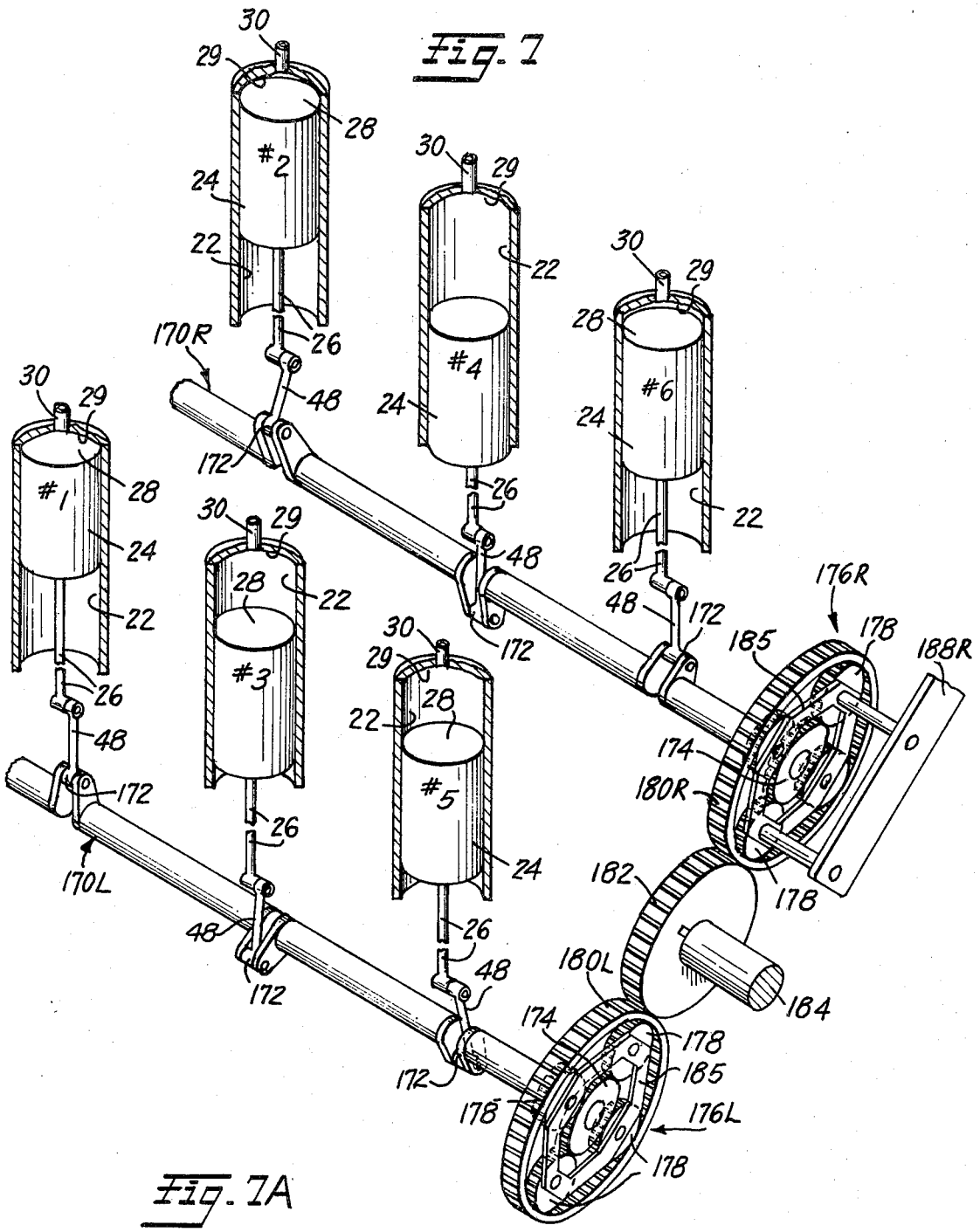
FIG. 7A is a chart showing the phase relationships between in each pair of thermodynamically coupled pistons in the engine shown in FIG. 7.

Turning now to FIG. 7, a six cylinder engine is shown having two crankshafts 170L and 170R. The crankshafts have cranks 172, like the cranks in the embodiment of FIG. 6 but with three cranks on each crankshaft, each crank having a crank angle displaced from the adjacent cranks by 120°. The phase position between the pistons connected to the cranks 172 can all be adjusted relative to their adjacent pistons because all the thermodynamically connected pistons are on separate crankshafts. Therefore, adjustment of the two crankshafts relative to each other changes the phase position of each piston relative to the thermodynamically connected pistons on both sides.

As shown in FIG. 7, the crankshafts 170 are each connected to a respective one of two sun gears 174 of two planetary gear sets 176 R and L. Each gear set 176 includes a set of planet gears 178 connected between the sun gear 174 and a ring gear 180 R and L having internal gear teeth which engage the teeth of the planet gears 178, and also external gear teeth which engage an output gear 182 keyed to an output shaft 184. The planet gears 178 are held in position by a planet gear frames 185 so that their axes remain fixed.

In operation, the reciprocating power exerted by the piston rods connected to the six pistons in the engine is converted by the cranks on the crankshafts 170 to rotating power of the crankshafts which in turn is transmitted by the sun gears 174 through the planets and the ring gears 180 R and L to the output gear 182 to produce rotating output power of the output shaft 184. When it is desired to change the phase positions of the crankshafts 170L and 170R, it can be accomplished by rotating the position of the set of planet gears 178 so that the position of the sun and the ring gears is shifted. Then the set of planets 178 is held in that position by the frame 185 during operation.

The mechanism for shifting the position of the planet gears 178 can be a simple lever 188 connected to the frames 185 linking the planet gears 178 together. Only one lever 188 R is shown for clarity of operation.

The invention accomplishes power and direction control for a double-acting Stirling engine and synergistically enables the engine to operate in a regenerative braking mode for optimum overall vehicle efficiency. It is a simple and reliable mechanism that can be incorporated into presently existing double-acting Stirling engine designs. It is capable with other power control techniques, such as mean power control, and compliments the characteristics of these power controls to provide a faster acting and smaller, lighter, and cheaper control system. The mechanism adds little or no weight to the vehicle and only trivial manufacturing and maintenance requirements, both of which are more than offset by the substantial advantages afforded by the invention.

Obviously, numerous modifications and variations of the invention will occur to those skilled in the art in light of the disclosure.

Accordingly, it is expressly to be understood that these modifications, and variations, and the equivalents thereof, may be practiced while remaining within the spirit and scope of the invention, as defined in the following claims, wherein I claim:

1. A power control for a double-acting Stirling engine having N pistons, where N is an even number greater than three, said pistons being normally operatively coupled to an output shaft with a phase angle of 360°/N between thermodynamically connected pistons; said power control comprising:

means for driving said output shaft;

means for linking said pistons to said driving means, including a linking mechanism connected between each piston and said driving means;

first means for shifting in a first angular direction the phase angle between said driving means and linking mechanisms associated with a first set of N/2 pistons, said first set consisting of every other piston in the thermodynamic loop; and second means for shifting in a second opposite angular direction the phase angle between said driving means and linking mechanisms associated with a second set of N/2 pistons, said second set consisting of the remaining alternate pistons in the thermodynamic loop.

2. The power control defined in claim 1, wherein said first means and said second means each shift the phase angle of said linking mechanisms an equal angular amount.

3. The power control defined in claim 1, wherein said first means shifts the phase angle of said linking mechanisms relative to said output shaft an equal angular amount.

4. The power control defined in claim 1, wherein said first means shifts the phase angle of said linking mechanisms relative to said output shaft an equal and opposite angular amount.

5. The power control defined in claim 1, wherein said linking means includes a helical connection between two elements in said linking mechanism, and said first and second shifting means includes means for axially moving at least one of said elements which enables the phase of said pistons to be changed relative to said output shaft.

6. The power control defined in claim 5, wherein said two elements include a linking gear engaged with a crank disc in turn linked to said piston, said linking gear having internal helical gear teeth, and a gear shaft having a set of external helical gear teeth with which said internal helical teeth are engaged, whereby axial movement of said gear shaft causes rotation of said crank disc relative to said gear shaft.

7. The power control defined in claim 5, wherein said two elements include a crank disc coupled to each of said pistons and having an external peripheral surface forming a helical gear, and a set of helical gears, including at least two of the opposite hand, engaged with said crank disc and mounted on a gear shaft, said set of helical gears being axially movable to change the phase angle between said pistons.

8. The power control defined in claim 1, wherein said means for driving are two parallel crankshafts to which said pistons are coupled, and said linking means includes a plurality of cranks on each crankshaft, and said first and second shifting means includes gears connected to said crankshafts to change the phase relationship between said crankshafts.

9. The power control defined in claim 8, wherein said pistons are connected to said crankshafts in alternating fashion whereby change of the phase relationship changes the phase relationship of all thermodynamically connected pistons an equal and opposite amount.

10. The control defined in claim 1, wherein said first and second shifting means includes gear means having an output gear connected to said output shaft, and two planetary gear sets, one each connected to each of said driveshafts; each of said planetary gear sets including a sun gear, a set of planet gears, and a ring gear; one each of said sun gears being connected to one of said driveshafts, respectively, and said ring gear being in meshing engagement with said output gear; and an adjustable planetary gear cage connected to said set of planet gears and movable to adjust the relative position of said sun gear and said ring gear.

11. The control defined in claim 10, further comprising:

means for adjusting the position of said planet gears on both planetary gear sets together, so that the degree of angular adjustment is the same on both planetary gear sets.

12. A power control and motion conversion mechanism for a double-acting Stirling engine having N pistons, where N is an even number greater than three, said pistons being thermodynamically coupled in series and mechanically connected through a drive train to an output driveshaft with a phase difference of 360°/N between adjacent pistons; said power control comprising:

helically threaded means for operatively connecting said pistons to said output driveshaft, said helically threaded means including at least one helically threaded member coupled to N/2 of said pistons, and at least one other helically threaded member connected to said output shaft and threadedly engaged with said one helically threaded member;

first means for shifting the phase position of N/2 pistons relative to the output shaft;

second means for shifting the phase position of the other N/2 pistons relative to the output shaft; and said first and second shifting means including means for axially moving said helically threaded members relative to each other to produce a rotation of said helically threaded members relative to each other, whereby the phase of said pistons relative to each other is changed.

13. The mechanism defined in claim 12, wherein said drive train includes two crankshafts, each of which is coupled to N/2 pistons, and said first and second shifting means includes gear means connected between said crankshafts and said output shaft and movable to shift the phase relationship between said crankshafts and said output shaft, and between said crankshafts.

14. The mechanism defined in claim 13, wherein said gear means includes two helical gears, one each splined to said crankshafts and movable axially relative thereto, a helical output gear connected to said output shaft and engaged with each of said two helical gears, said axial movement imparting a relative rotation between said two helical gears and said helical output gear.

15. A power control for a double-acting Stirling engine having N pistons, where N is an even number equal to or greater than four, said pistons being operatively coupled through a drive train to an output drive shaft with a phase difference of 360°/N; said power control comprising:

a shifter for shifting the phase position of at least N/2 pistons relative to the other N/2 pistons which operate in a Stirling cycle working space bounded in part by the first mentioned N/2 pistons, said shifter including a set of crank discs, one each linked to each of said pistons, for converting the reciprocating motion of said pistons to rotating motion and a helical member having a helical connection between said crank discs and said output driveshaft; means for relatively axially moving said helical connection to cause N/2 of said crank discs to rotate relative to the other N/2 crank discs and thereby change the phase position of the pistons linked thereto relative to each other.

16. The power control defined in claim 15, wherein said helical member includes a linking gear engaged with said disc and having a helically grooved bore, and a rod having a helically grooved portion passing through said bores.

17. The power control defined in claim 15, wherein said helical member is a helical gear engaged with helical teeth on the peripheral edge of said crank disc and axially movable to cause rotation of said crank disc and thereby change the phase of the piston connected thereto.

18. A phase shift mechanism for a double-acting Stirling engine having N pistons where N is an even number equal to or greater than four, and the nominal phase relationship between thermodynamically coupled pistons is 360°/N, said mechanism including:

two sets of N/2 motion conversion devices for converting between reciprocating motion of said pistons and rotating motion of an output shaft, said devices including a pair of crankshafts having N/2 cranks set 720°/N apart and each linked to a piston;

each piston linked to one crankshaft being thermodynamically connected to two other pistons on the other crankshaft;

gear means connected between each of said crankshafts and an output gear on said output shaft and shiftable to change the phase between said crankshafts and thereby change the phase relationship between said piston pairs an equal and opposite amount, whereby the output power from said pistons changes by approximately equal amounts.

19. The mechanism defined in claim 18, wherein said gear means includes two planetary gear sets, one each connected to one of said crankshafts.

20. The mechanism defined in claim 19, wherein said planetary gear sets each include an externally geared ring gear engaged with an output gear keyed to said output power shaft.

21. The mechanism defined in claim 18, wherein said gear means includes two helical gears, one each splined on the end of a respective one of said crankshafts and axially movable relative thereto, said helical gears being engaged with a mating helical drive gear fixed to an output shaft, whereby axial movement of said movable helical gears causes relative rotational translation between said output drive gear and said movable helical gears, whereby the phase position of said pistons is changed when said movable helical gears are moved axially.

22. A mechanism for shifting the phase between pistons in a double-acting Stirling engine having N pistons where N is an even integer greater than three, and the nominal phase relationship between thermodynamically coupled pistons is 360°/N, said mechanism including:

two sets of N/2 motion conversion devices for converting between reciprocating motion of said pistons and rotating motion of an output shaft, said motion conversion devices each including an externally geared crank disc to which said pistons are linked;

means for shifting the phase angle between said two sets of motion conversion devices relative to each other and thereby shift the phase of the thermodynamically connected pistons;

said phase shifting means including a set of linking gears mounted on a shaft and engaged with said crank discs, said linking gears and said discs being movable relative to each other in opposite directions on discs coupled thermodynamically adjacent pistons to produce a relative phase change between thermodynamically adjacent pistons.

23. The mechanism defined in claim 22, wherein said linking gears are mounted on said shaft for controlled rotation relative thereto, and said phase shift means further includes means for rotating said gear on said shaft a predetermined amount and thereafter holding said shaft and said gear at the predetermined angular orientation.

24. The mechanism defined in claim 23, wherein said linking gear and shaft rotation means includes a helical spline on said shaft and a corresponding helical spline in said linking gear, said splines being engaged so that axial movement of said shaft causes relative rotation of said shaft and said linking gear; and means for moving said shaft axially to cause said relative rotation of said shaft and said linking gear.

25. The mechanism defined in claim 22, wherein said linking gear is a helical gear and said crank disc has an externally geared helical periphery engaged with said linking gear, and further comprising means for moving said shaft axially to cause a relative phase shift between said shaft and said crank disc.

* * * * *